US005692809A

United States Patent [19]

Hook

[11] Patent Number: 5,692,809

[45] Date of Patent: Dec. 2, 1997

[54] IN-LINE SKATE WHEELS

[76] Inventor: Kenneth Wayne Hook, 1147 Old Hickory Rd., Corona, Calif. 91720

[21] Appl. No.: 444,206

[22] Filed: May 18, 1995

[51] Int. Cl.[6] ..... B60B 27/00

[52] U.S. Cl. ..... 301/5.3; 301/64.4

[58] Field of Search ..... 301/5.3, 5.7, 64.4, 301/10.1, 11.1; 280/11.22, 11.23; 152/393, 394

[56] References Cited

U.S. PATENT DOCUMENTS

| | | | |
|---|---|---|---|
| 287,861 | 11/1883 | Rice . | |
| 1,006,952 | 10/1911 | King | 301/5.3 |
| 1,460,183 | 6/1923 | Snyder | 301/5.3 |
| 1,604,643 | 10/1926 | Harlowe | 280/11.22 |
| 1,803,019 | 4/1931 | Holm | 301/64.4 X |
| 1,980,479 | 11/1934 | Gannett | 152/394 X |
| 1,983,869 | 12/1934 | Nichol | 301/5.3 X |
| 2,105,317 | 1/1938 | Frank | 301/64.4 X |
| 2,709,471 | 5/1955 | Smith et al. | 301/11.1 X |
| 2,948,889 | 7/1960 | Woldring et al. | 301/64.4 |
| 3,589,149 | 6/1971 | Fischer | 301/64.4 |
| 3,695,728 | 10/1972 | Haussels | 301/64.7 X |
| 3,823,952 | 7/1974 | Kukulowicz | 280/11.22 X |
| 4,090,283 | 5/1978 | Woolley . | |
| 4,909,523 | 3/1990 | Olson . | |
| 5,308,152 | 5/1994 | Ho . | |
| 5,366,232 | 11/1994 | Pozzobon et al. | 280/11.22 |
| 5,390,941 | 2/1995 | Pozzobon et al. | 301/5.7 X |
| 5,478,140 | 12/1995 | Racosky | 301/5.7 |
| 5,503,466 | 4/1996 | Lew | 301/5.3 |

*Primary Examiner*—Russell D. Stormer
*Attorney, Agent, or Firm*—Lyon & Lyon LLP

[57] ABSTRACT

An in-line skate wheel has a tire attached to a rim that mates to form a relatively rigid interlocking assembly with a wheel hub having concentric inner and outer hub rings interconnected nearly adjacent their outer edges by radially extending vanes. To enable rotation about an axis of rotation, a pair of bearings are co-axially retained by the wheel hub and mounted on a bearing sleeve located internal to the wheel hub.

24 Claims, 4 Drawing Sheets

IN-LINE SKATE WHEELS

FIELD OF THE INVENTION

This invention relates to roller skates and, more particularly, to in-line skate wheels that facilitate increased operational speed, durability, safety and cost efficiency.

BACKGROUND OF THE INVENTION

The popularity of in-line roller skates has grown significantly in recent years. In-line skates are not only being used for recreation and fitness training, their popularity has grown into competitive racing or speed-skating. These skates typically comprise a plurality of wheels positioned to rotate within a single central vertical plane. However, a number of different skates with various wheel structures and configurations are currently being manufactured and sold. FIGS. 1, 1A, 2 and 2A show two typical wheel structures currently available.

Referring to FIGS. 1, 1A, 2 and 2A, the same and similar components are numbered the same. Typically, the wheel comprises a urethane tire T molded to a one piece, normally plastic or some other synthetic material, hub H. In FIGS. 1 and 1A, the hub H comprises concentric inner and outer hub rings 1 and 2. The outer hub ring 2 is connected to the inner hub ring 1 via radially extending and arcuately spaced hub vanes 3. To increase rigidity or stiffness, the vanes 3 are oriented transversely, rather than parallel, to a central vertical plane C. When the urethane tire T is molded to the hub H, the tire T encases the outer hub ring 2 and the hub vanes 3.

The hub H in FIGS. 2 and 2A, includes a hub extension ring 7 that is concentric with inner and outer hub rings 1 and 2. In addition, transversely oriented hub extension vanes 8 radially extend between and attach to the hub extension ring 7 and the outer hub ring 2. When molded to the hub H, the tire T encases the hub extension ring 7 and hub extension vanes 8 rather than the outer hub ring 2 and the hub vanes 3.

Both types of hubs H retain a bearing assembly 4 interior to the inner hub ring 1. The bearing assembly 4 enables the tire T and hub H to rotate about an axle 5 which is inserted through the hub H, the bearing assembly 4 and a skate frame F. A fastener 6 is tightened onto the axle's 5 threaded end to fix the wheel to the frame F.

Although these wheels appear to perform better overall than earlier wheels, prolonged use in hot conditions or under high loads due to high speeds or a heavy skater, tends to cause failures in the tire T, the hub H or the bearing assembly 4. The hub H in FIGS. 1 and 1A tends to transfer heat from the bearing assembly 4 to the inner hub ring 1 and the tire T. The hub H also tends to deform under high loads due to inherent strength limitations associated with the lightweight hub H material. As the hub deforms, it causes the bearing assembly 4 to cant out of alignment and, thus, generate additional heat. The tire T, the hub H and the bearing assembly 4 become more susceptible to failure as the hub H deforms and heats up. The tire T, for example, will start to melt and peel away from the inner hub ring 1 as the hub H deforms and heats up.

The wheel configuration shown in FIGS. 2 and 2A, which provides limited cooling of the inner hub ring 1, slightly alleviates the problem of heat being transferred from the hub H to the tire T. However, the number and size of the hub vanes 3 necessary to maintain rigidity in this hub H configuration, diminishes the efficiency by which the inner hub ring 1 is cooled. As a result, the wheel configuration in FIGS. 2 and 2A suffers from the same problems caused by deformation of the hub H and the generation of heat.

Furthermore, as the hub H deforms it absorbs energy, or work performed by the skaters, needed to propel the skates forward. Thus, skaters that desire to go faster have to resort to using a tire T made from a harder material. The skater will go faster with a harder tire T because the rigidity of the tire material will increase the overall rigidity of the wheel. A more rigid wheel absorbs less energy or work performed by the skater. The harder material, however, reduces the tire's T ability to grip the skating surface which increases the likelihood that the skater will have an accident due to the wheels of the skates slipping out from under the skater.

An additional shortcoming of these wheels arises from the fact that the tire T is molded to the one piece hub H. Therefore, once the tire T fails, is damaged, or simply wears out, the whole wheel must be discarded. Thus, use of these wheels can prove to be relatively expensive.

Therefore, it would be desirable to have an in-line skate wheel that facilitates increased operational speed, durability, safety and cost efficiency and, more particularly, an in-line skate wheel that is more rigid, that eliminates canting, that dissipates heat more efficiently, that reduces heat transfer to the tire, and that comprises reusable components.

SUMMARY OF THE INVENTION

The in-line skate wheel of the present invention serves to facilitate increased operational speed, durability, safety and cost efficiency. It preferably has a urethane tire attached to a generally cylindrical rim which mates with a wheel hub to form a relatively rigid interlocking assembly. The wheel hub preferably includes releasably connected opposing hub halves that, when connected, clamp the rim therebetween. Each of the hub halves comprises concentric radially spaced inner and outer hub rings that are interconnected nearly adjacent their outer edges by radially extending vanes. A pair of bearings are co-axially retained by the wheel hub and mounted on a bearing sleeve co-axially located internal to the wheel hub. Once mounted to a skate frame, the wheel hub, bearings and bearing sleeve assembly enable the in-line skate wheel to rotate about an axis of rotation.

An object of this invention is to provide improved in-line skate wheels. Further objects and advantages of the present invention will become apparent from a consideration of the drawings and ensuing description.

DESCRIPTION OF THE PREFERRED EMBODIMENT

Figure 1:
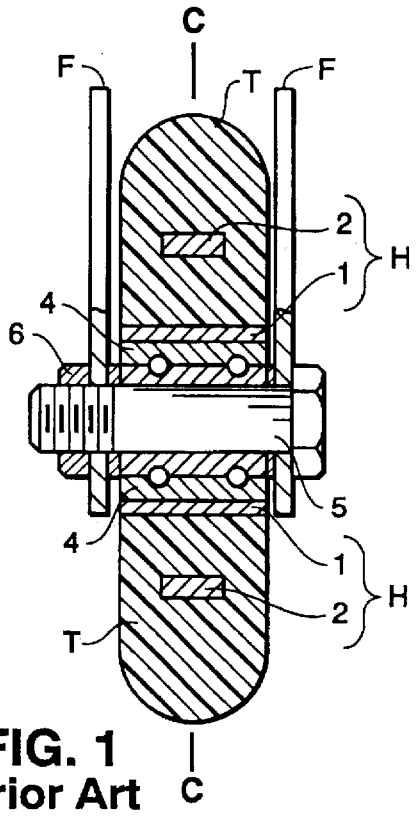
FIG. 1 Prior Art
FIG. 1 is a cross sectional view of a prior art in-line skate wheel mounted to a skate frame.
Figure 1A:
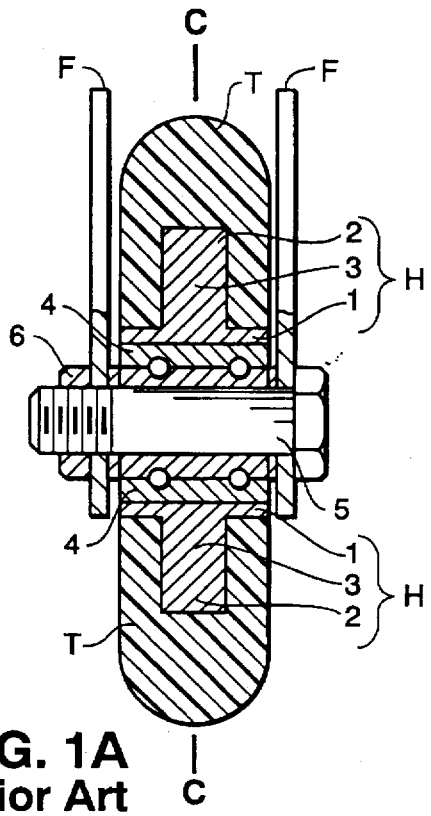
FIG. 1A Prior Art
FIG. 1*a* is second cross-sectional view of the prior art in-line skate wheel shown in FIG. 1.
Figure 2:
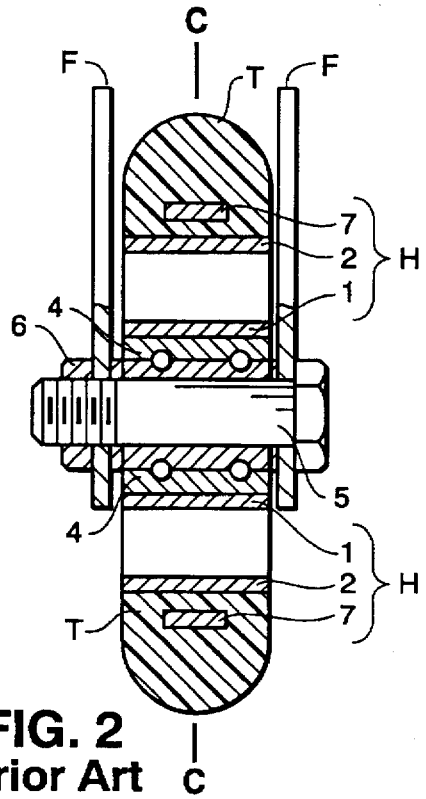
FIG. 2 Prior Art
FIG. 2 is a cross-sectional view of another prior art in-line skate wheel mounted to a skate frame.
Figure 2A:
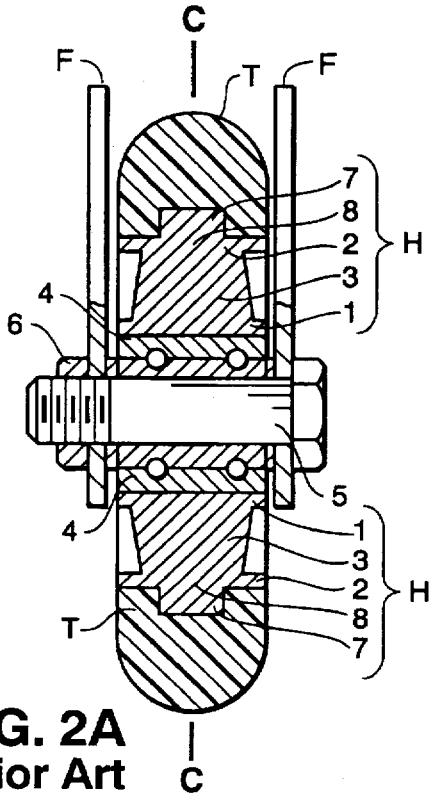
FIG. 2A Prior Art
FIG. 2*a* is a second cross-sectional view of the prior art in-line skate wheel shown in FIG. 2.
Figure 3:
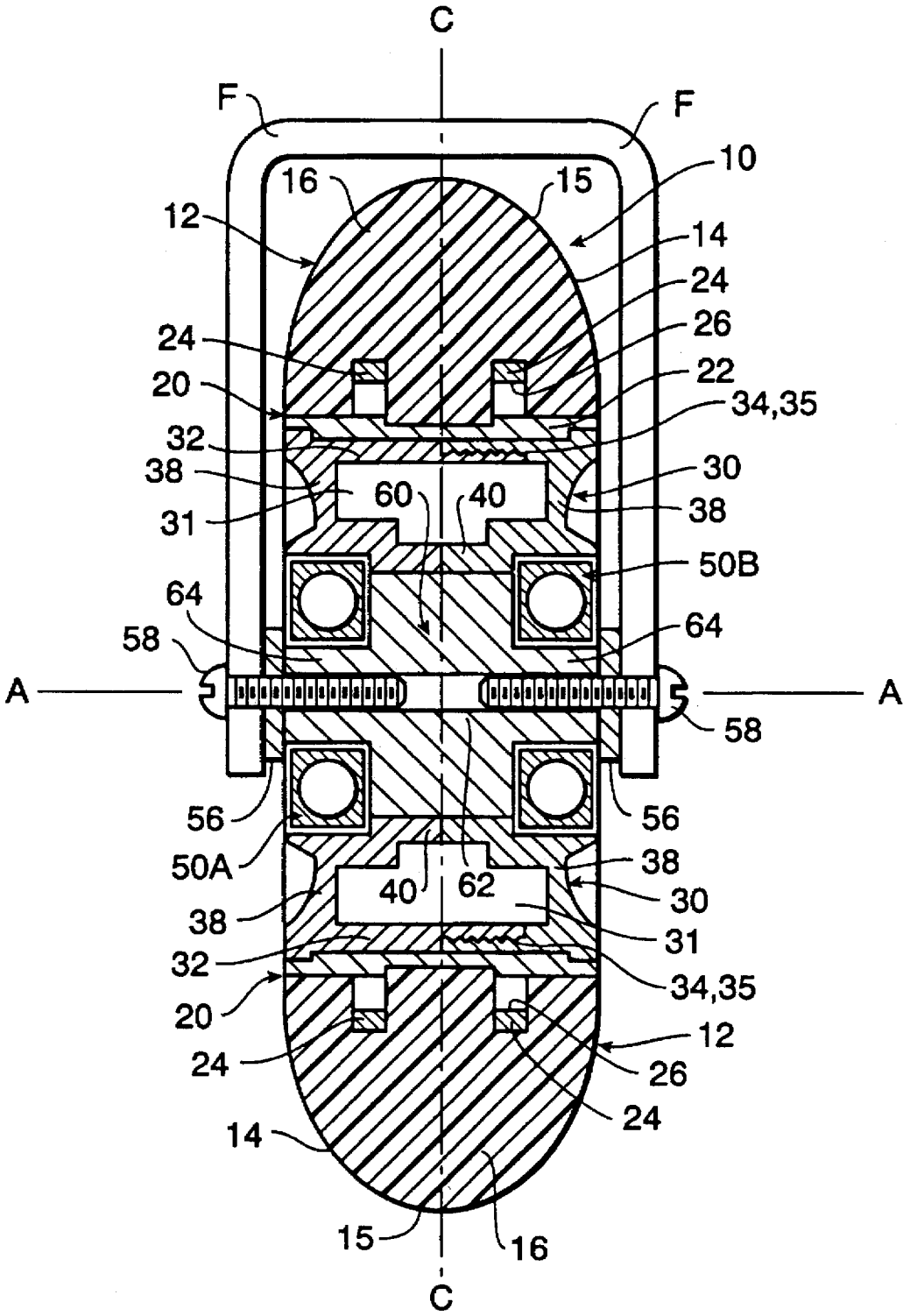
FIG. 3 is a cross-sectional view of an in-line skate wheel of the present invention mounted to a skate frame.
Figure 4:
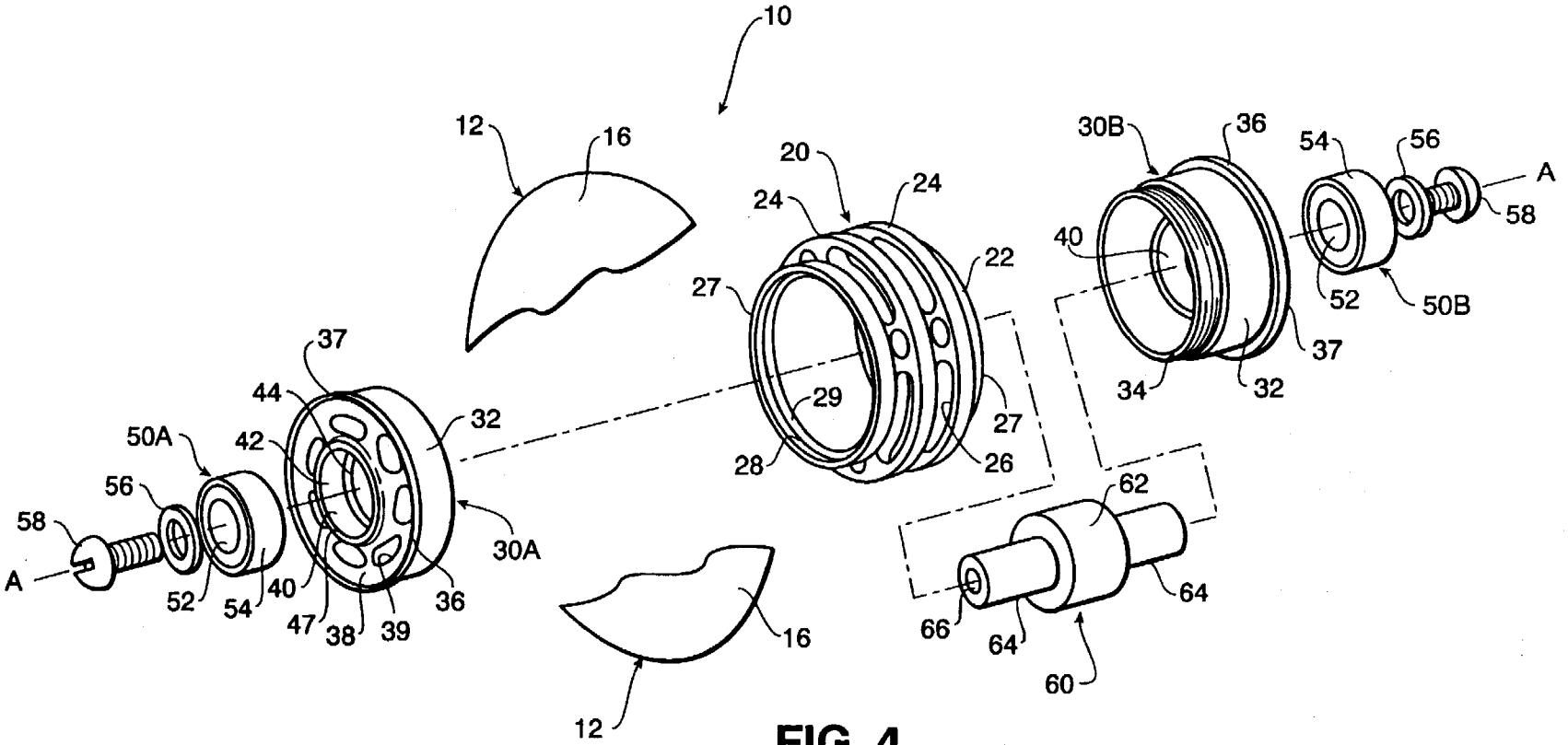
FIG. 4 is an isometric exploded assembly view, including a fragmented view of a tire, of the in-line skate wheel of the present invention.

Referring now in detail to FIGS. 3–9, therein illustrated is a novel in-line skate wheel 10 of the present invention. The in-line skate wheel 10 comprises a tire 12 molded to a rim 20 which mates with a wheel hub 30 to form an interlocking assembly. A bearing sleeve 60 is internally received within the wheel hub 30. The wheel hub 30 receivably retains on its opposing sides a pair of roller bearings 50*a* and 50*b* mounted on the bearing sleeve 60. A pair of mounting screws 58 attach the in-line skate wheel 10 to a skate frame F (see FIG. 3) which is spaced from the bearings 50*a* and 50*b* by a pair of washers 56. The skate frame F can be considered to diagramatically illustrate a skate having a plurality of in-line skate wheels 10 of the present invention.

The rim 20 is preferably precision machined from a billet of aluminum or other material having substantially the same weight and strength characteristics of aluminum. However, as will become apparent when discussing the wheel hub 30, the rim 20 may be machined or molded from a material having similar weight, but not necessarily similar strength characteristics, i.e., plastic.

The rim 20 comprises a substantially and relatively thin cylindrical rim body 22 having a pair of annular ribs 24 extending radially from and annularly about the exterior of the rim body 22. The annular ribs 24 are equally spaced from the central vertical plane C of the in-line skate wheel 10 and have a plurality of apertures 26 punched, cut or molded therein. An annular hub recess 28 is co-axially located on opposing sides of the rim 20. The hub recesses 28 extend inwardly from the outer edges 27 of the rim body 22 and form a shoulder 29 within the rim body 22 which acts as a hub abutment. The hub abutments 29 are located parallel to, and equidistant from, the central vertical plane C of the in-line skate wheel 10.

The tire 12 is preferably made from a relatively soft urethane material having a hardness value near the low end of a hardness range of 75–100 on an A-scale. The urethane material of the tire 12 is molded about the rim 20, forming an annular shaped tire body 16. The tire body 16 material encases the annular ribs 24 and its apertures 26, thus making it difficult to peel the tire 12 away from the rim 20. The outer surface 14 of the tire body 16 is arcuately shaped wherein a cross-sectional arc 15 is centered about the central vertical plane C of the in-line skate wheel 10.

The wheel hub 30 is also preferably precision machined from a billet of aluminum or other material having substantially similar weight and strength characteristics. The resulting rigidity of the wheel hub 30 is sufficient to substantially eliminate canting of the in-line skate wheel 10 under high loads and is sufficient to enable the use of a relatively soft urethane tire 12 material.

Figure 5:
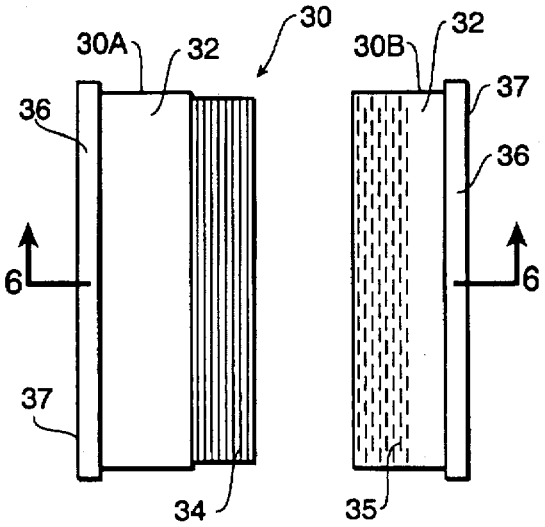
FIG. 5 is a plan view of a wheel hub of the in-line skate wheel of the present invention.
Figure 6:
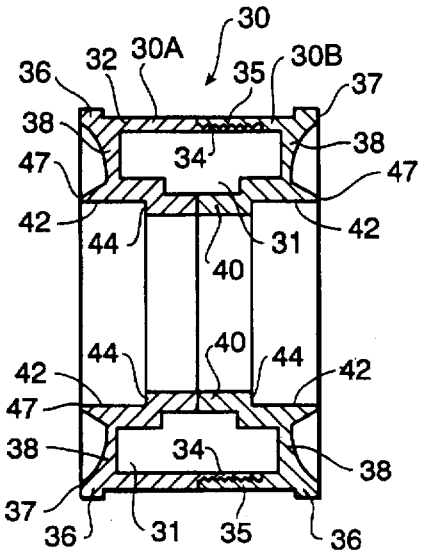
FIG. 6 is a cross-sectional view of the wheel hub taken along a line 6—6 in FIG. 5.
Figure 7:
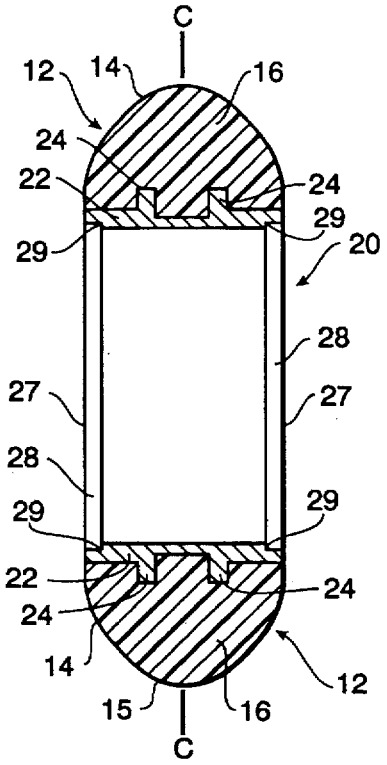
FIG. 7 is a cross-sectional view of the tire and a rim of the present invention.
Figure 8:
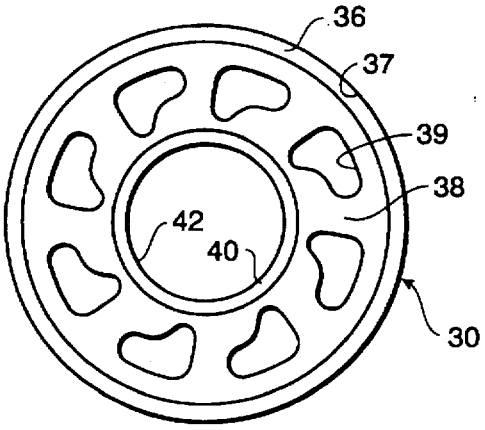
FIG. 8 is a end view of the wheel hub.
Figure 9:
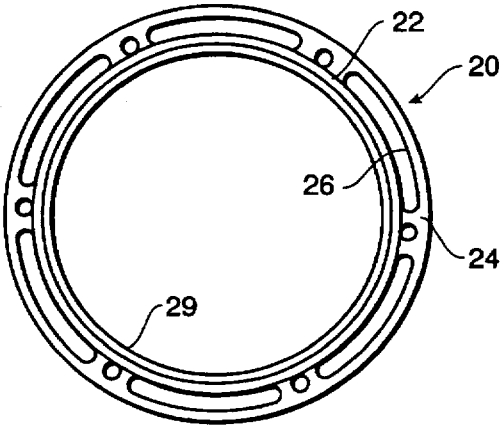
FIG. 9 is a end view of a rim of the in-line skate wheel of the present invention.

The wheel hub 30 comprises two opposing and threadably connected wheel hub halves 30*a* and 30*b* (see FIGS. 5–6). Each half 30*a* and 30*b* of the wheel hub 30 comprises two radially spaced concentric rings, an outer hub ring 32 and an inner hub ring 40 which are relatively thin and substantially cylindrical in shape. Relatively thin, annular vanes 38 radially extend between the inner and outer rings 40 and 32 fixedly connecting the inner ring 40 to the outer ring 32 of the wheel hub 30. The annular vanes 38 are located nearly adjacent to the outer edges 37 and 47 of the outer and inner hub rings 32 and 40, respectively, and substantially parallel to and egui-distantly spaced from the central vertical plane C of the in-line skate wheel 10. In this configuration, a space 31, which is interposed between the inner hub ring 40 and the outer hub ring 32 and bordered on opposing ends by the vanes 38, is substantially only filled with air that enters through a plurality of apertures 39 in the vanes 38. This relatively large air space 31 between the inner and outer hub rings 40 and 32 tends to more efficiently dissipate heat generated by the bearings 50*a* and 50*b* and thus, tends to reduce heat transfer to the tire 20.

The right wheel hub half 30*b* further comprises a threaded ring extension 34 which extends from the outer ring 32 opposite the outer ring's 32 outer edge 37. The external threads of the ring extension 34 are received within an internally threaded bore 35 of the left wheel hub half 30*a*. The ring extension 34 is screwed into the bore 35 to interlock the wheel hub halves 30*a* and 30*b* together.

Rim retainers 36 form an annularly shaped shoulder about the exterior of the outer hub ring 32 on each side of the outer hub ring 32, nearly adjacent the outer edges 37. The rim retainers 36 are located parallel to, and equidistant from, the central vertical plane C of the in-line skate wheel 10. The rim retainers 36 are received in the hub recesses 28 and abut the hub abutments 29 of the rim 20 as the wheel hub halves 30*a* and 30*b* are slidably received within the rim 20. Screwing the threaded ring extension 34 into the threaded bore 35 clamps the rim 20 between the rim retainers 36 and tightly mates the wheel hub 30 to the rim 20 to form a rigid interlocking assembly that tends to substantially eliminate canting of the in-line skate wheel 10.

A bearing recess 42 is located on opposing sides of the inner hub ring 40. The bearing recesses 42 extend inwardly from the outer edges 47 of the inner hub ring 40 forming a shoulder 44, which acts as a bearing abutment. The bearing abutments 44 are located annularly about the interior of the inner hub ring 40 and, parallel to and equidistant from the central vertical plane C of the in-line skate wheel 10. An outer race 54 of the bearings 50*a* and 50*b* is frictionally retained within the bearing recesses 42 and abuts the bearing abutments 44 within the inner hub ring 40. An inner race 52 of the bearings 50*a* and 50*b* is frictionally received over sleeve extensions 64 of the bearing sleeve 60. The outer race 54 of the bearings 50*a* and 50 is operably connected to the inner race 52 such that it rotates about and relative to the inner race 52 of the bearings 50*a* and 50*b*.

The bearing sleeve 60 is co-axially located within the inner hub ring 40 of the wheel hub 30 along the axis of rotation A of the in-line skate wheel 10. The bearing sleeve 60 comprises an axle 62 formed in central portion of the bearing sleeve 60 to substantially eliminate play between the bearing 50*a* and 50*b* and the axle 62. The bearing sleeve 60 that steps down on opposing sides of the axle 62 at shoulders 68 to the sleeve extensions 64. The sleeve extensions 64 extend outwardly in opposing directions from the axle 62. The shoulders 68 on either side of the axle 62 are located parallel to the central vertical plane C and are substantially eguidistantly spaced from the central vertical plane C at a distance equal to the distance that the bearing abutments 42 of the inner hub ring 40 of the wheel hub 30 are spaced from the central vertical plane C. Thus, the bearings 50*a* and 50*b* are aligned within the bearing recesses 42 in the inner hub ring 40 by both the shoulders 69 on the bearing sleeve 60 and the bearing abutments 44 within the inner hub ring 40. This results in the center plane C of the in-line skate wheel 10 tending to be maintained in a centered position within the frame F.

A threaded bore 66 is tapped through the sleeve extensions 64 and the axle 62 of the bearing sleeve 60. The threaded bore 66 is sized to receive the mounting screws 58 when mounting the in-line skate wheel 10 to the skate frame F.

The in-line skate wheel structure 10 of the present invention is easily assembled and disassembled. To assemble the in-line skate wheel 1, the wheel hub halves 30*a* and 30*b* are inserted into the rim 20 having a tire 12 molded thereon. The wheel hubs 30*a* and 30*b* are then rotated within the rim 20 to screw the ring extension 34 of the right wheel hub half 30*b* into the bore 36 of the left wheel hub half 30*a*. As the wheel hub halves 30*a* and 30*b* are screwed together, the rim retainers 36 align up against the hub abutments 29 in the hub recesses 28 of the rim 20, thus clamping the rim 20 between the rim retainers 36 and mating the wheel hub 30 to the rim 20 to form a rigid, interlocking assembly. Next, one of the bearings 50 is mounted on one of the sleeve extensions 64 abutting the shoulder 68 of the bearing sleeve 60. The bearing sleeve 60 and bearing 50 assembly is then inserted, bearing sleeve 60 first, into the inner hub ring 40 until the bearing 50 abuts the bearing abutment 44 as it is slidably received in one of the bearing recesses 42 of the inner hub ring 40. The other bearing 50 is then mounted on the other sleeve extension 64 while being slidably received in the other one of the bearing recesses 42. The bearing 50 is inserted into the bearing recess 42 and onto the sleeve extension 64 until it abuts both the shoulder 68 of the bearing sleeve 60 and the bearing abutment 44 of the bearing recess 42. This in-line skate wheel 10 assembly is then mounted onto the frame F by screwing the mounting screws 58 into the threaded bore 66 in the bearing sleeve 60. A washer 56, however, is first interposed on both sides of the in-line skate wheel 1, between the frame F and the inner race 52 of the bearings 50*a* and 50*b*. The washer 56 provides sufficient spacing between the outer race 54 and the frame F to enable the in-line skate wheel 10 to freely rotate about its axis of rotation A without any interference between the outer race 54 of the bearings 50*a* and 50*b* and the frame F.

To disassemble, the in-line skate wheel 10 is dismounted from the frame F by unscrewing the mounting screws 58 from the bearing sleeve 60. The bearings 50*a* and 50*b* and the bearing sleeve 60 are then slid out of the wheel hub 30. The tire 12 and the rim 20 are then released from the wheel hub 30 by unscrewing the hub extension ring 34 of the right wheel hub half 30*b* from the bore 35 of the left wheel hub half 30*a*.

The structure of the in-line skate wheel 10 of the present invention, provides benefits and advantages over the prior art. The increased rigidity of the interlocking assembly of the wheel hub 30 and the rim 20 tends to eliminate any undesirable canting of the bearings 50*a* and 50*b*, which tends to reduce undue wear on the bearings 50*a* and 50*b* and the consequential generation of undesirable heat within the wheel hub 30. In addition to tending to eliminate canting, the rigid interlocking assembly of the wheel hub 30 and rim 20 tends to increase the efficiency by which the work performed by the skater translates into forward motion of an in-line skate. Moreover, the tire 12 need not be relatively more rigid to increase a skater's speed. Rather the tire 12 can be made of a softer urethane material which provides better traction, which results in increased safety as well as speed.

Furthermore, the structure of the wheel hub 30 tends to reduce tire 12 wear and failure due to heat being transferred from the wheel hub 30 to the tire 12. The space between the inner and outer hub rings 40 and 32, which is formed by interconnecting the concentric inner and outer hub rings 40 and 32 on opposite sides, nearly adjacent their outer edges 37 and 47, by annular vanes 38 extending there between, is merely filled with air that cools the wheel hub 30. The air flows into the space through the apertures 39 in the vanes 38. Thus, relatively little heat is transferred from the bearings 50*a* and 50*b* through the inner hub ring 40 to the outer hub ring 32, to the rim 20 and to the tire 12.

Additionally, the in-line skate wheel 10 of the present invention tends to reduce the cost of operation. Unlike the prior art which tends to provide a one piece wheel member which requires the hub to be discarded with the worn or damaged tire, the in-line skate wheel 10 of the present invention can simply mount a new tire 12 and rim 20 assembly onto an existing wheel hub 30 which can then be mounted back onto the skate frame F. Thus, the cost of replacing the hub of an in-line skate wheel is eliminated.

Thus, the in-line skate wheel of the present invention provides many benefits over the prior art. While the above description contains many specificities, these should not be construed as limitations on the scope of the invention, but rather as an exemplification of one preferred embodiment thereof. Many other variations are possible.

Accordingly, the scope of the present invention should be determined not by the embodiments illustrated above, but by the appended claims and their legal equivalents.

What is claimed:

1. An in-line skate wheel comprising a generally cylindrical rim, a tire attached to said rim, and a wheel hub comprising opposing hub halves having inner and outer radially spaced concentric rings, said hub halves being releasably connected and having mating threads, with one of said hub halves being threadably screwed into the other one of said hub halves clamping said rim therebetween.

2. The in-line skate wheel of claim 1, wherein said inner and outer rings have outer edges and said wheel hub further comprises a vane radially extending between said inner and outer rings adjacent said outer edges of said inner and outer rings of said hub halves.

3. The in-line skate wheel of claim 1, wherein said rim comprises at least one rib radially and annularly extending about the exterior of said rim.

4. The in-line skate wheel of claim 3, wherein said at least one rib comprises a plurality of apertures therein.

5. The in-line skate wheel of claim 4, wherein said tire comprises a urethane material molded to said rim and encasing said rib.

6. An in-line skate wheel comprising a generally cylindrical rim, and a wheel hub having separable hub halves, with said rim being releasably captured by said hub halves, said wheel hub including a plurality of radially spaced concentric rings having outer edges, said plurality of radially spaced concentric rings being interconnected adjacent their respective outer edges.

7. The in-line skate wheel of claim 6, wherein said rim comprises at least one rib radially and annularly extending about the exterior of said rim.

8. The in-line skate wheel of claim 7, wherein said at least one rib comprises a plurality of apertures therein.

9. The in-line skate wheel of claim 6, further comprising a tire disposed on said rim.

10. The in-line skate wheel of claim 6, wherein said plurality of radially spaced concentric rings comprises a generally cylindrical inner hub ring, and a generally cylindrical outer hub ring concentric with and radially spaced from said inner hub ring, said inner and outer hub rings being interconnected adjacent the outer edges of said inner and outer hub rings.

11. The in-line skate wheel of claim 10, wherein each of said hub halves of said wheel hub further comprises a vane radially extending between said inner and outer rings, said vane being located adjacent the respective outer edges of said inner and outer rings.

12. The in-line skate wheel of claim 6, wherein said wheel hub halves are releasably connected and have interlocking threads, wherein one of said hub halves is threadably screwed into the other one of said hub halves to clamp said rim therebetween.

13. An in-line roller skate comprising a frame, a wheel mounted to said frame, said wheel comprising a rim, a tire disposed on said rim, a wheel hub having releasably interlocking hub halves interlocked with said rim, each of said hub halves comprising an inner hub ring, an outer hub ring concentric to and radially spaced from said inner hub ring, said inner and outer hub rings having outer edges, and a vane radially extending between said inner and outer hub rings adjacent said outer edges of said inner and outer hub rings, a bearing sleeve internal to said wheel hub, and a bearing retained by said wheel hub and mounted on said bearing sleeve.

14. The in-line roller skate of claim 13, wherein said rim further comprises a rib radially extending about the exterior of said rim.

15. The in-line roller skate of claim 13, wherein said tire is molded from a urethane material.

16. The in-line roller skate of claim 13, wherein said vane of said wheel hub further comprises a plurality of apertures formed therein.

17. The in-line roller skate of claim 13, wherein said wheel hub further comprises a bearing recess internal to said inner hub ring.

18. The in-line roller skate of claim 17, wherein said bearing comprises an inner race, and an outer race operably connected to said inner race, said outer race being rotatable relative to said inner race and frictionally retained within said bearing recess of said wheel hub.

19. The in-line roller skate of claim 18, wherein said bearing sleeve comprises a pair of opposing sleeve extensions, at least one of said sleeve extensions being frictionally received within said inner race of said bearing, and an axle interposed between said sleeve extensions.

20. The in-line roller skate of claim 13, wherein said hub halves comprise mating threads.

21. An in-line roller skate comprising a frame, a plurality of wheels mounted to said frame, each of said plurality of wheels comprising a rim, a tire attached to said rim, a wheel hub having releasably interlocking opposing hub halves interlocking said rim therebetween, each of said hub halves comprising an inner hub ring having an outer edge, an outer hub ring concentric to and radially spaced from said inner hub ring, said outer hub ring having an outer edge, and a vane radially extending between said inner and outer hub rings adjacent said outer edges of said inner and outer hub rings, a bearing sleeve internal to said wheel hub, and a bearing retained by said wheel hub and mounted on said bearing sleeve.

22. An in-line skate wheel comprising a generally cylindrical rim, and a wheel hub including threadably coupled first and second hub members releasably coupled to said rim, said first hub member having a generally cylindrical inner hub ring, and a generally cylindrical outer hub ring concentric with and radially spaced from said inner hub ring, said inner and outer hub rings having an outer edge and being interconnected adjacent the outer edge of said inner and outer hub rings.

23. The in-line skate wheel of claim 22, wherein said wheel hub further comprises a vane radially extending between said inner and outer hub rings, said vane being located adjacent the outer edge of said inner and outer rings.

24. An in-line skate wheel comprising a generally cylindrical rim, a tire molded to said rim, and a wheel hub attached to said rim, said wheel hub including a plurality of radially spaced concentric rings having outer edges and being interconnected adjacent said outer edges of said concentric rings, said wheel hub including releasably connected opposing hub halves having mating threads, one of said hub halves being threadably screwed into the other one of said hub halves to clamp said rim therebetween.

* * * * *

UNITED STATES PATENT AND TRADEMARK OFFICE

CERTIFICATE OF CORRECTION

PATENT NO. : 5,692,809

DATED : December 2, 1997

INVENTOR(S) : Kenneth Wayne Hook

It is certified that error appears in the above-indentified patent and that said Letters Patent is hereby corrected as shown below:

Item [56]

On the cover page, under "References Cited", add the following reference:

--5,567,019 10/1996 Raza et al. 301/5.3--

Column 4, line 4, change "egui-distantly" to --equidistantly--.

Column 4, line 60, change "eguidistantly" to --equidistantly--.

Column 5, line 12, change "36" to --35--.

Signed and Sealed this

Twenty-first Day of April, 1998

Bruce Lehman

*Attest:*

BRUCE LEHMAN

*Attesting Officer*

*Commissioner of Patents and Trademarks*